United States Patent [19]

Woitschätzke et al.

[11] 4,109,931

[45] Aug. 29, 1978

[54] SKI BRAKE

[75] Inventors: Hans Woitschätzke, Grunwald; Hennoch Geyer, Munich, both of Fed. Rep. of Germany

[73] Assignee: Trak Sportartikel GmbH, Grunwald, Fed. Rep. of Germany

[21] Appl. No.: 735,984

[22] Filed: Oct. 27, 1976

[30] Foreign Application Priority Data

Oct. 30, 1975 [DE] Fed. Rep. of Germany ..... 2548667

[51] Int. Cl.[2] ..... A63C 7/10

[52] U.S. Cl. ..... 280/605

[58] Field of Search ..... 280/605, 604, 603

[56] References Cited

U.S. PATENT DOCUMENTS

| | | | |
|---|---|---|---|
| 2,997,309 | 8/1961 | van Natter | 280/605 |
| 3,873,108 | 3/1975 | Lacarrau et al. | 280/604 |
| 4,012,057 | 3/1977 | Courvoisier | 280/605 |

FOREIGN PATENT DOCUMENTS

| | | | |
|---|---|---|---|
| 2,228,504 | 12/1974 | France | 280/605 |
| 199,810 | 11/1938 | Switzerland | 280/604 |

*Primary Examiner*—David M. Mitchell

[57] ABSTRACT

A ski brake comprising at least one braking member which, when no load is applied by a foot, protrudes from the plane of the ski running surface, and upon application of a load by a foot lies substantially within the ski body.

2 Claims, 18 Drawing Figures

Fig.6
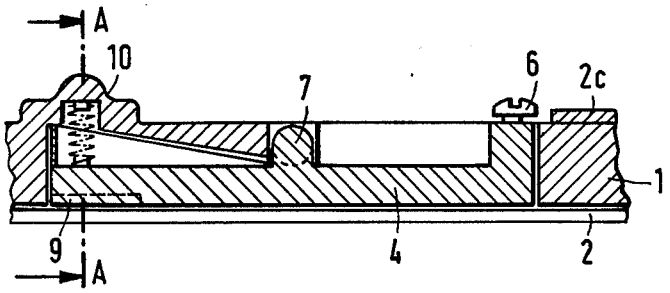
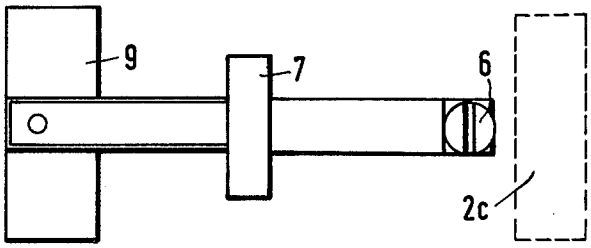
Fig.7
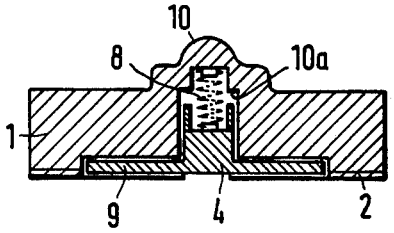
Fig.8

SKI BRAKE

BACKGROUND OF THE INVENTION

1. Field of the Invention

The invention relates to a ski braking means for preventing a ski from continuing downhill when it becomes detached from the boot.

2. Description of the Prior Art.

The numerous known ski braking means of this type are disadvantageous in several respects such that so far their use in place of tethers has not gained acceptance.

First of all, all parts of the known ski braking means are provided above and laterally of the ski body, respectively, especially the braking member is arranged along one side edge of the ski. This is the cause for the disadvantages listed below:

(a) The running resistance of the ski in trackless snow is considerably increased, because the track produced by the upturned ski tip must be continually widened by the braking members.

(b) On sloping courses during canting of the ski edges or on turns the lateral braking member will frequently scrape into the snow and so decrease the speed. Particularly, sudden decreases in speed of the more steeply canted ski edges may result in dangerous falls.

(c) With most of such ski braking means, after relief of a tension spring by release of the ski boot the braking members are swung out laterally downwardly, thus inhibiting further running on the ski running surface. In most cases, the suddenly braked skis will be hurled through the air, and the extended braking members may injure other skiers.

(d) A risk of injury caused by the protruding braking members also during insertion of the foot into the ski binding and during tensioning of the braking means, respectively, as well as during ski transport.

(e) Assembling problems, since assembly of the braking means is effected later by drilling and threading fasteners into the ski body, which is not only cumbersome but also weakens the ski body.

(f) Complicated operation and high price, which is why they are unsuitable particularly for children's skis.

(g) Danger of icing and thus of failure to release, as snow will be collected on the protruding braking members.

SUMMARY OF THE INVENTION

It is therefore the object of the invention to provide a ski braking means of the type specified, which is of simple construction, easily operated and yet effective, and which neither obstructs running nor incurs a risk of injury.

With the subject-matter of the invention, during skiing basically no part will protrude from the ski body, or at most within the dimensions of the safety binding. The skier will not be handicapped by the braking member, as the bottom surface of the latter is substantially in alignment or flush with the running surface or the tracking groove of the ski, respectively. Even when the braking member is slightly offset to the rear, there will be no impediment during skiing.

One embodiment of the invention, which utilizes a thrust bolt, ensures not only a very simple operation of the ski braking means but in this embodiment the thrust bolt for operating the braking member may protrude in the braking position to a relatively great extent from the ski upper surface, for when the safety binding is locked the abutting surface thereof will press the bolt downwards so that the bolt will not represent an annoyance; this entails an increased overall height of the bolt and consequently facilitates the structural design of the braking means.

Further, locking of the braking member in the non-braking position is also possible with very simple means, so that also during transport of the ski there will neither be any damage of the braking member nor will the braking member represent a cause of danger for persons or objects.

The ski braking means according to the invention may be used with particular advantage in conjunction with skies manufactured by common techniques from plastic material. The required recess may be provided in the ski during manufacture thereof without any significant extra labour. Weakening of the ski by the recess need not be feared. Even if the recess is provided at a later time, the use of the ski for skiing will not be impeded as the deflection of the loaded ski in the region of boot and binding is minimized so as not to endanger an easy and reliable binding release by a shortening of the spacing between front and rear jaws of the safety binding. If the recess is provided at the time of manufacture of the ski, this area may, if desired, be reinforced with little expense.

A set screw permits the height adjustment of the braking member with respect to the ski boot and the boot sliding strip, respectively. As the braking member of the pivotable embodiment in its protruding portion is preferably given such a height that there will be no free space between the ski running surface and the braking member, no snow will get beneath the braking member even when the ski slides with the braking member swung out.

A particular braking effect is achieved by the provision of two parallel levers at the braking member or by the use of a plate at the protruding end of the long arm of an L-shaped lever as a braking member. When two such braking members are mounted on a ski behind one another and with opposite swing, braking of the ski in either direction is achieved in a simple manner.

Certain other embodiments of the invention are still more advantageous, as a braking effect in either direction will be obtained from the very beginning.

BRIEF DESCRIPTION OF THE DRAWINGS

Embodiments of the ski braking means according to the invention will be described below with reference to the drawing, in which

FIG. 6 is a longitudinal sectional view of a second embodiment of the ski braking means of the invention, in which the braking member at its front comprises a plate;

FIG. 7 is a plan view of the ski braking means of FIG. 6, the front part of the binding having been lifted off;

FIG. 8 is a cross-sectional view along the line A — A of the ski braking means of FIGS. 6 and 7 at the level of a spring;

DESCRIPTION OF THE PREFERRED EMBODIMENTS

Figure 1:
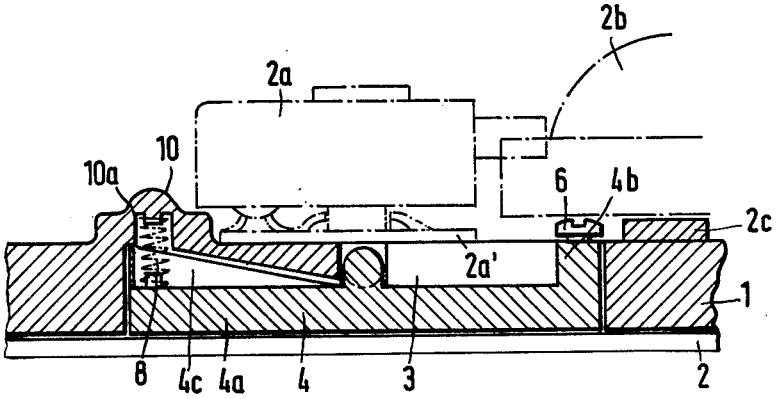
FIG. 1 is a longitudinal sectional view of a first embodiment of the ski braking means of the invention, in which the braking member has been swung inwards by the ski boot.

In a first, basic embodiment of the ski braking means of the invention at least one braking member is used, which is pivotable about a transverse axis of the ski body. FIGS. 1 to 13 show various embodiments of this type.

In FIGS. 1 to 4, which show a first embodiment of the ski braking means of the invention, there is provided a recess 3 in a ski body 1 beneath a forward binding part or front jaw 2*a* of a safety binding, said recess 3 being open at the running surface 2 of the ski over the entire extent thereof but being covered in its front portion at the ski upper surface by a section 3*a* of the ski body 1.

The recess 3 includes a central transverse space. In an already finished ski, the recess 3 may be cut into the body 1 of the ski so that the ski braking means may be mounted later. The recess 3 may, however, be provided already during manufacture of the ski, e.g. when the ski is made from plastic material, most of the manufacturing methods for plastic materials (e.g. injection molding, thermoplastic foam casting, or polyurethane) permitting the forming of the recess 3 without extra costs.

In the embodiment of the ski braking means according to the FIGS. 1 to 4, which comprises only a single braking member, the recess 3 ends at the ski running surface 2 within the area of the tracking groove.

According to the FIGS. 1 to 4 the braking member consists of an L-shaped lever 4 having a long arm 4*a* and a short arm 4*b*. Approximately centrally, the L-shaped lever 4 has a pivot axis 7, which is provided on the long arm 4*a* and may, especially in the case of manufacture from plastic material, be formed integrally therewith.

The braking member is inserted in the recess 3 from the ski upper surface. The long arm 4*a* at the rear end of the braking member as viewed in running direction extends almost to the ski upper surface or, respectively, to a bottom plate 2*a*′ of the front jaw 2*a* of the safety binding, it being advantageous that the bottom plate 2*a*′ also covers the recess 3.

A set screw 6, provided on the short arm 4*b*, permits an accurate setting of the effective height so that the ski boot 2*b*, which is clamped in the front jaw 2*a* and the sole of which is pressed onto a boot sliding strip 2*c*, will firmly press onto the set screw 6 and thus onto the braking member formed by the L-shaped lever 4. Thus, the ski braking means is adjusted by the set screw 6 in such a manner that in the tensioned condition, i.e., when loaded by the ski boot 2*b*, the set screw 6 will be at the same levels as the boot sliding strip 2*c* and at the same time the L-shaped lever 4 will be swung into the ski body 1. In the case of a ski made from plastic material the boot sliding strip 2*c* may be integrally formed in the ski body 1.

Figure 2:
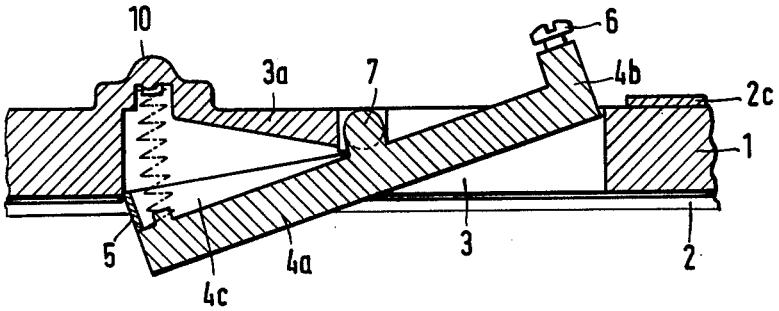
FIG. 2 is a longitudinal sectional view similar to FIG. 1, in which, however, the braking member is shown in the swung-out position released by the ski boot.
Figure 3:
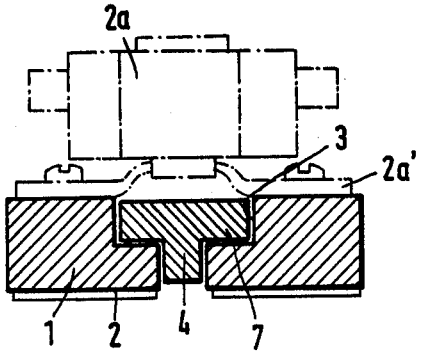
FIG. 3 is a cross-sectional view of the ski braking means of FIGS. 1 and 2 at the level of the pivot axis of the braking member.
Figure 4:
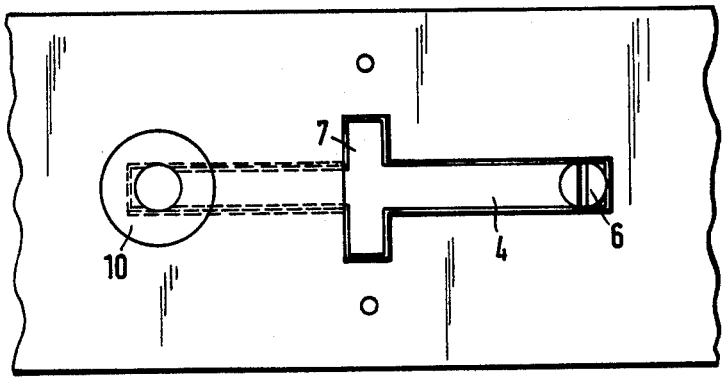
FIG. 4 is a plan view of the upper surface of the ski including a built-in ski braking means according to the FIGS. 1 to 3, the front part of the binding having been removed.

As is clearly apparent from the FIGS. 1 and 2, the long arm 4*a* of the L-shaped lever 4 may be formed as a uniformly rising wedge extending from the pivot axis 7 in ski running direction. This wedge portion has a longitudinally extending slot 4*c* permitting in the forward part thereof the anchoring of one end of a spring 8, the other end of said spring being anchored in a blind bore 10*a* in a boss 10 formed on the ski upper surface.

In simple embodiments it will, however, suffice that the long arm 4*a* is of uniform, e.g. square, cross-section.

When no ski boot 2*b* presses onto the L-shaped lever 4 by way of the set screw 6, the front end (viewed in ski running direction) of the long arm 4*a* is pressed downwardly by the spring 8 and out of the ski running surface 2, so that said end will protrude into the snow and the ski cannot glide inadvertently in the direction of the ski tip. So that no snow will be pressed into the recess 3 and the long arm 4*a* will not be damaged by the braking, respectively, the wedge provided at the front end of the long arm 4*a* is of such a height that even in the fully swung-out position of the L-shaped lever 4 no gap will remain between the lever and the recess 3, the enlarged front face of the wedge increasing the braking effect.

As soon as the ski boot 2*b* applies pressure to the set screw 6, the boot being secured in upward direction by the front jaw 2*a* of the safety binding, the L-shaped lever 4 will be fully swung into the ski body 1 so that it cannot form an impediment to skiing. The bottom surface of the lever may be flush with the running surface 2 of the ski or it may be somewhat offset in rearward direction (cf. in this respect FIG. 3).

So as to prevent any kind of damage to the ski during transport, a sliding bar 31 or a similar locking element may be provided on the ski upper surface (cf. the FIGS. 17 and 18), which sliding bar maintains the L-shaped lever 4 in its withdrawn position also when no load is applied by a ski boot; the sliding bar may include an upwardly protruding portion which, when the ski boot is placed onto the ski, facilitates pushing-back of the sliding bar and thus a release of the braking member 4, i.e., the ski braking means is automatically brought into a state ready for release. In particular, the sliding bar 31 includes a lateral slot in which a transverse pin 31*a* is provided permitting sliding motion of the sliding bar 31 in longitudinal direction of the ski. The recess 3 is covered by a cover plate 29. The dashed lines in FIG. 17 indicate the pushed-back position of the sliding bar 31, in which the L-shaped lever 4 has been swung out.

Figure 5:
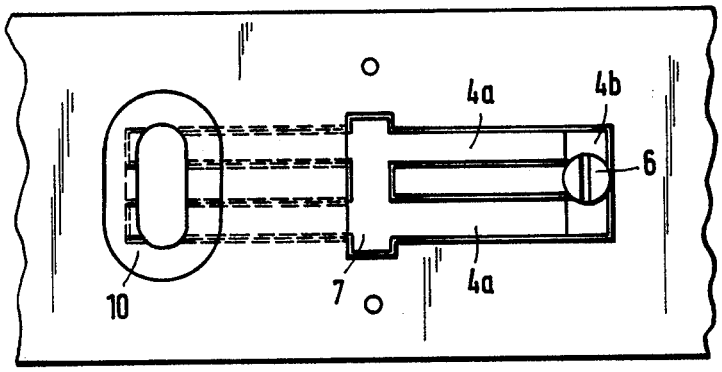
FIG. 5 is a plan view similar to FIG. 4, but showing a braking member having two parallel arms.

As shown in FIG. 5, the L-shaped lever may also include two long arms 4*a* extending parallel to each other, which at their front ends terminate separately but are joined at their rear ends through a common short arm 4*b*. In this double-arm embodiment the braking member lies in the ski running surface on either side of the tracking groove.

As shown in FIGS. 6 to 8, a transversely extending plate 9 may be provided at the end or ends of the long arms 4*a* adapted to be swung out, so that the braking effect is enhanced.

With the embodiments of the ski braking means according to the invention described so far, an effective braking is ensured only in one direction, i.e., in the ski running direction. These embodiments will be especially useful when the ski running surface is scaled (cf. e.g. Published German Patent Application No. 1,578,922), i.e., when the running surface itself already effects a braking against backward sliding.

However, in the case of skis having a smooth running surface an additional safeguard against unintentional backward sliding is desirable.

Figure 9:
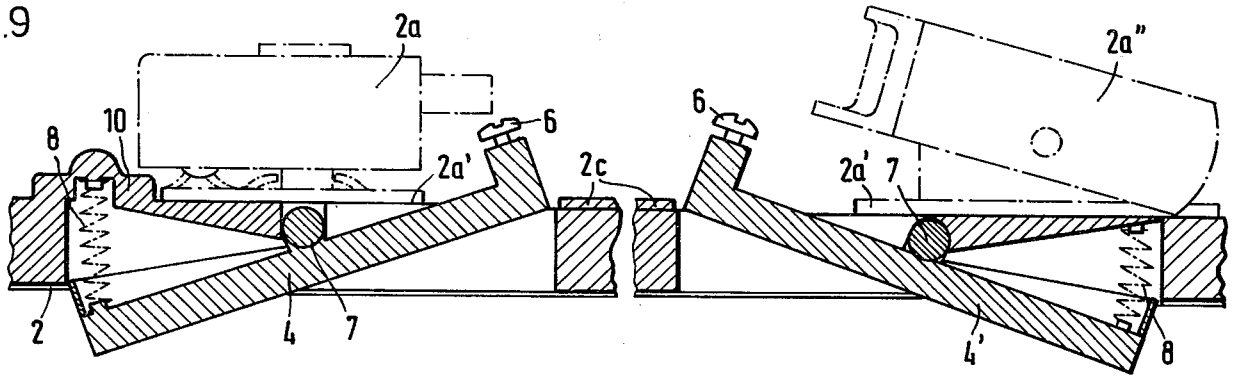
FIG. 9 is a longitudinal sectional view of a third embodiment of the ski braking means of the invention having two braking members provided one behind the other.
Figure 10:
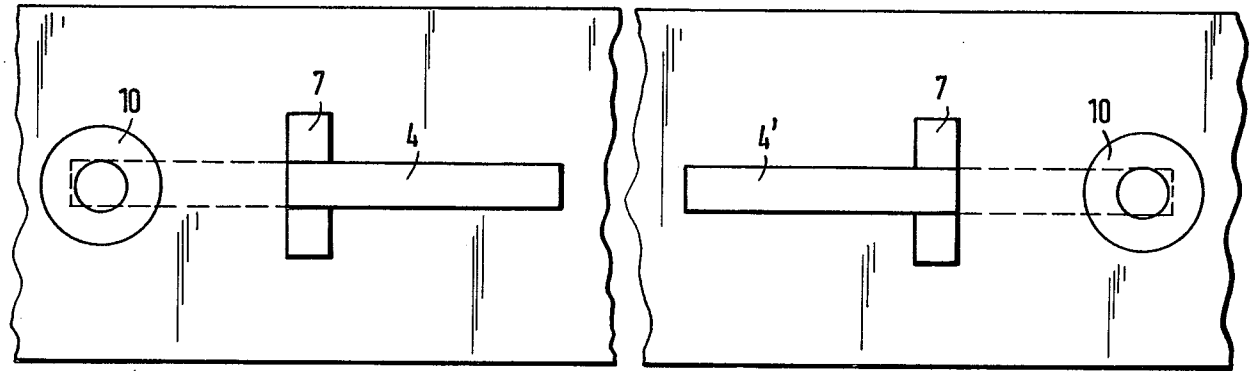
FIG. 10 is a plan view of the ski braking means of FIG. 9, the parts of the binding having been removed.

This is achieved with the third embodiment shown in FIGS. 9 and 10, which is practically a duplication of the ski braking means shown in FIGS. 1 to 4 but with a second, rear brake having an opposite swinging direction, and in which the second L-shaped braking member 4' is installed beneath the rear jaw 2*a*" of a safety binding in the ski boot 1.

Figure 11:
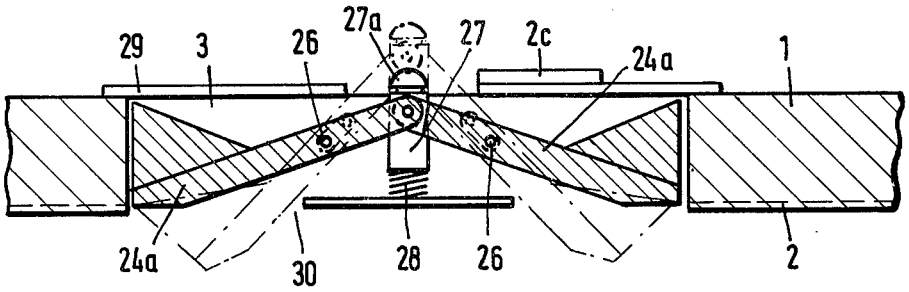
FIG. 11 is a longitudinal sectional view of a fourth embodiment of the ski braking means of the invention having two coupled braking members, which are adapted to be swung out in different directions.
Figure 12:
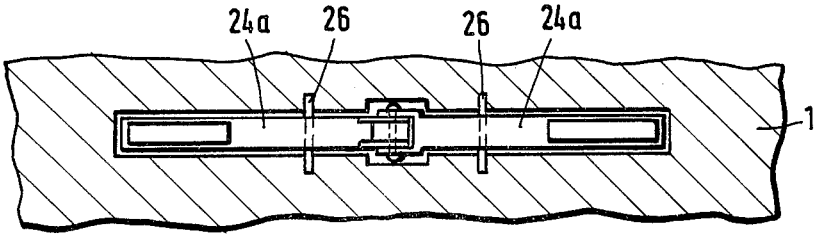
FIGS. 12 and 13 are a plan view of a cross-sectional view, respectively, of the ski braking means of FIG. 11.
Figure 13:
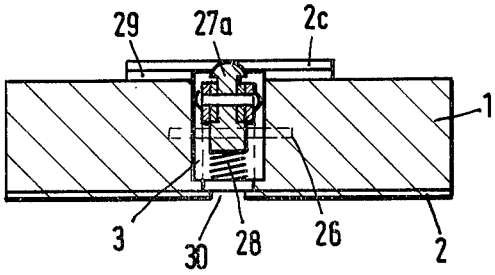

A fourth embodiment of the ski braking means of the invention shown in the FIGS. 11 to 13 represents, as it were, a simplification of the embodiment shown in FIGS. 9 and 10 in that a single thrust bolt 27 resting on a spring 28 and having a bolt head 27*a* for operating two braking arms 24*a* is employed, said braking arms forming two braking members and being pivotally connected to the thrust bolt 27. Each of the two braking arms 24*a* is also pivotable about a transverse pin 26 mounted in lost motion slots in the ski body (indicated in dotted lines), as is clearly apparent from FIG. 11. For the rest, each braking arm 24*a* is provided within a punched out portion 30, and the top of the recess 3 in the ski body 1 is covered by a cover plate 29 and a boot sliding strip 2*c*.

With the embodiment of the ski braking means shown in FIGS. 11 to 13 there is, however, a tendency for snow to penetrate into the punched out portions 30, and possibly that cover plates 29 may not be arranged in sufficiently close relationship.

Figure 14:
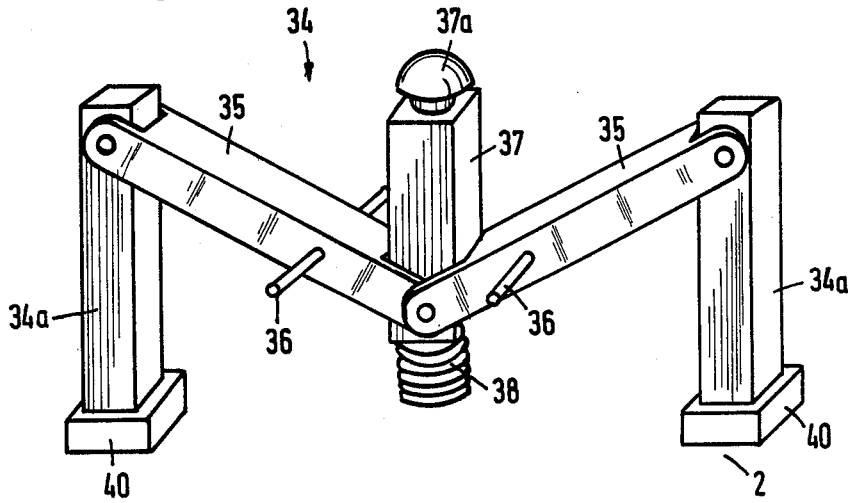
FIG. 14 is a perspective view of a fifth embodiment of the ski braking means of the invention at a larger scale than the FIGS. 1 to 13 (the ski body being omitted) in non-braking position.
Figure 15:
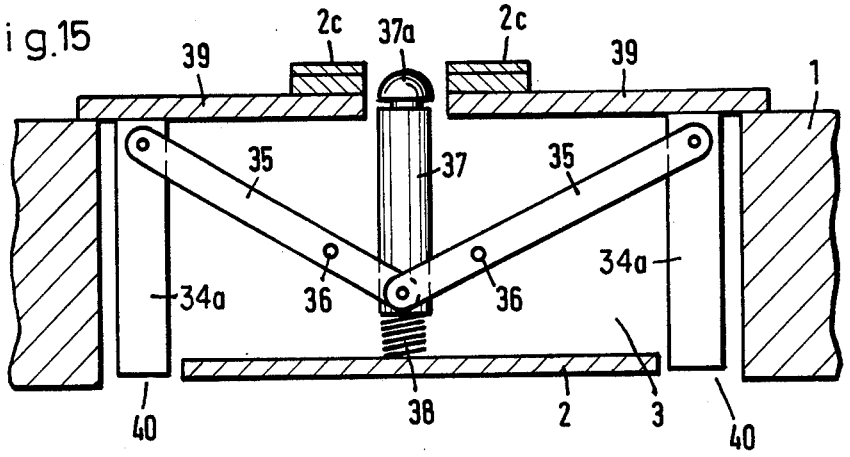
FIG. 15 is a longitudinal sectional view of the ski braking means of FIG. 14.
Figure 16:
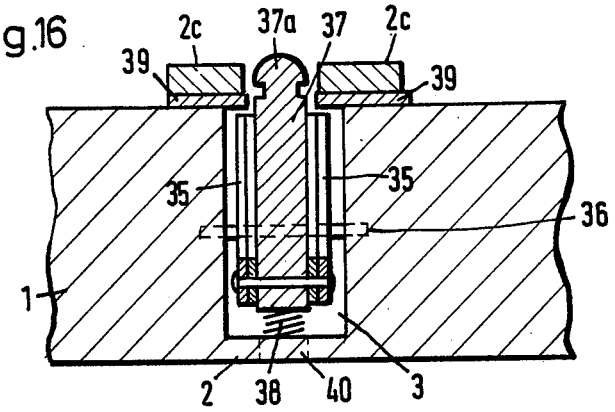
FIG. 16 is a cross-sectional view of the ski braking means of FIG. 15 at the level of the thrust bolt.

In this respect, therefore, the other basic embodiment of the ski braking means of the invention shown in the FIGS. 14 to 16 is more advantageous.

This ski braking means comprises a braking member 34 having two rod-like braking bolts 34*a* of approximately square cross-section, which are guided in a recess 3 of the ski body 1 vertically with respect to the ski running surface 2. At their upper ends the braking bolts 34*a* are pivotally connected with connecting arms 35 which in turn are downwardly inclined and pivotally connected to transverse pins 36 and the lower ends of which are pivotally connected to a thrust bolt 37. The pins 36 may be mounted in lost motion slots, as in the embodiment shown in FIGS. 11–13. The thrust bolt 37 is vertically guided in the recess 3 and loaded at its lower end by a spring 38 while the upper end carries a bolt head 37*a* which may also be formed as a set screw. The bolt length may be adjusted in such a manner that during application of load by a ski boot the bolt will be fully pressed into the cover plate of the recess 3 in the ski body 1 or that particularly in case of boot sliding strips 2*c* being used the bolt will be at the same level as said strip so that the braking member 34 is retracted (cf. FIGS. 14 to 16).

The braking member 34 is installed in such a manner in the recess 3 that in the case of no-load condition of the ski the lower ends of the braking bolts 34*a* will protrude outwardly from guide recesses 40 formed in the ski running surface and also the head 37*a* of the thrust bolt 37 will protrude from the cover plate 39 and beyond the boot sliding strip 2*c*, respectively. As this ski braking means also is installed in the ski body 1 in the area of a binding section, the ski boot 2*b* clamped into the binding will apply pressure to the head 37*a* of the thrust bolt 37 and will thus retract the lower ends of the braking bolts 34*a* into the ski body 1. The lower ends of the braking bolts 34*a* may be either flush with the running surface 2 or slightly withdrawn therefrom. When the ski boot is lifted off the ski and the thrust bolt 37 is released, the lower ends of the braking bolts 34*a* will immediately emerge from the ski body 1 and cause braking.

The ski braking means according to the invention is preferably mounted in such a manner that the braking bolts 34*a* are positioned centrally with respect to the longitudinal axis of the ski. In case of the ski having a tracking groove the braking bolts 34*a* will emerge in the area of said groove.

The parts of the braking member 34 may be made of corrosion resistant metal or also of plastic material. Also, the cover plate 39 and the boot sliding strip 2*c* may form a unit.

The running properties of the ski are in no way impaired by the ski braking means shown in FIGS. 14 to 16. The ski braking means is effective in either direction. It is therefore insignificant whether a free ski runs unintentionally with its tip or its trailing portion leading.

Figure 17:
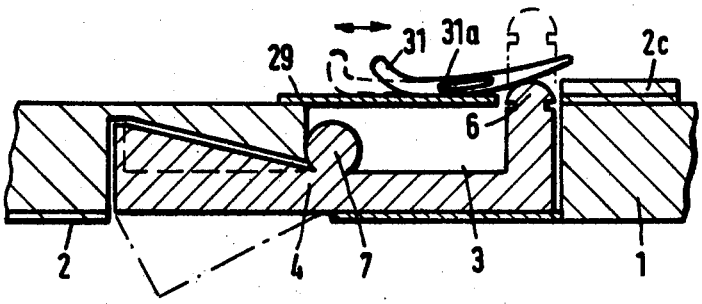
FIG. 17 and FIG. 18 are a longitudinal sectional view and a plan view, respectively, of the embodiment of FIGS. 1 to 4 comprising a sliding bar for locking the ski braking means during transport, FIG. 18 being drawn to a smaller scale than FIG. 17.
Figure 18:
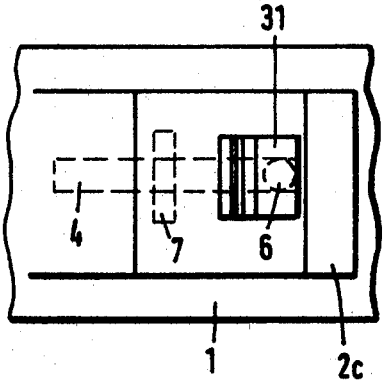

With this embodiment, too, a safeguard similar to that shown in FIGS. 17 and 18 may be provided by means of which the thrust bolt 37 may be locked in the depressed position so as to prevent, e.g. during transport, a damaging of the braking bolts 34*a* and the ski running surface 2.

What is claimed is:

1. A ski braking means for a ski having a running surface, an upper surface, and a body, said body having a recess, said ski braking means comprising:

two downwardly extending braking bolts positioned and guided in said recess, said bolts, when no load is applied by a foot through a boot, protruding from the plane of said ski running surface, and, upon application of a load by a foot through a boot, lying substantially within said recess of said ski body, said ski braking means further comprising:

a pair of posts extending transversely in said recess and connected to said ski body, a pair of connecting arms extending longitudinally of said ski in said recess, said arms being respectively pivotable about said posts, a thrust bolt extending upwardly within said recess, and a spring positioned to bias said thrust bolt upwardly, said ski upper surface having an opening therethrough communicating with said recess for permitting said thrust bolt to extend above said ski upper surface for contacting a boot, whereby a load applied by a foot through said boot will depress said thrust bolt against the bias of said spring, each of said arms being pivotally connected to said thrust bolt at one end of each of said arms and being connected to a respective said braking bolt at the opposite end of each said arms, said running surface of said ski having at least two openings therethrough for permitting said braking bolts to extend below said ski running surface when no load is applied downwardly on said thrust bolt whereby said spring moves said thrust bolt upwardly, thereby pulling up the ends of said arms connected to said thrust bolt and causing said arms to pivot about said posts and, because said arms are connected to said braking bolts, to drive said braking bolts through said openings in said ski running surface.

2. The ski braking means of claim 1 wherein said thrust bolt has a head that is a set screw.

* * * * *